US005086755A

United States Patent [19]

Schmid-Eilber

[11] Patent Number: 5,086,755

[45] Date of Patent: Feb. 11, 1992

[54] THERAPEUTIC CHAISE LONGUE

[75] Inventor: Helmut Schmid-Eilber, Ölbronn-Dürrn, Fed. Rep. of Germany

[73] Assignee: GfPE-Gesellschaft für Persönlichkeitsentwicklung GmbH, Ölbronn-DüRRN, Fed. Rep. of Germany

[21] Appl. No.: 383,595

[22] Filed: Jul. 24, 1989

[30] Foreign Application Priority Data

Jul. 27, 1988 [DE] Fed. Rep. of Germany ..... 3825454

[51] Int. Cl.[5] ..... A61H 1/00

[52] U.S. Cl. ..... 128/33; 128/32; 128/54; 128/55

[58] Field of Search ..... 128/33, 32, 54, 55

[56] References Cited

U.S. PATENT DOCUMENTS

| | | | |
|---|---|---|---|
| 3,556,088 | 1/1971 | Leonardini | 128/33 |
| 3,880,152 | 4/1975 | Nohmura | 128/33 |
| 4,023,566 | 10/1975 | Martinmaas | 128/33 |
| 4,055,170 | 10/1975 | Nohmura | 128/33 |
| 4,310,307 | 1/1988 | Bellisario | 128/207.13 |
| 4,354,067 | 10/1982 | Yamada et al. | 128/33 |
| 4,635,287 | 1/1987 | Hirano | 128/33 |
| 4,753,225 | 6/1988 | Vögel | 128/33 |

*Primary Examiner*—Edgar S. Burr
*Assistant Examiner*—Lisa E. Malvaro

[57] ABSTRACT

A chaise longue for therapeutic treatment of a patient consists of three support sections hinged together so as to be pivotable relative to one another for comfortably supporting a patient which support sections have openings formed therein spaced along the longitudinal centerline of the chaise longue and electroacoustic transducers movably disposed below the openings and adapted to radiate upwardly through the openings at the lower back, the chest and the head/neck areas of a patient resting on the chaise longue with an enhanced signal of a frequency corresponding to the rhythm frequency of certain music to which the patient's body is exposed which rhythm frequency is in the non-audible range and adapted to achieve total relaxation of the patient.

6 Claims, 1 Drawing Sheet

Fig. 1
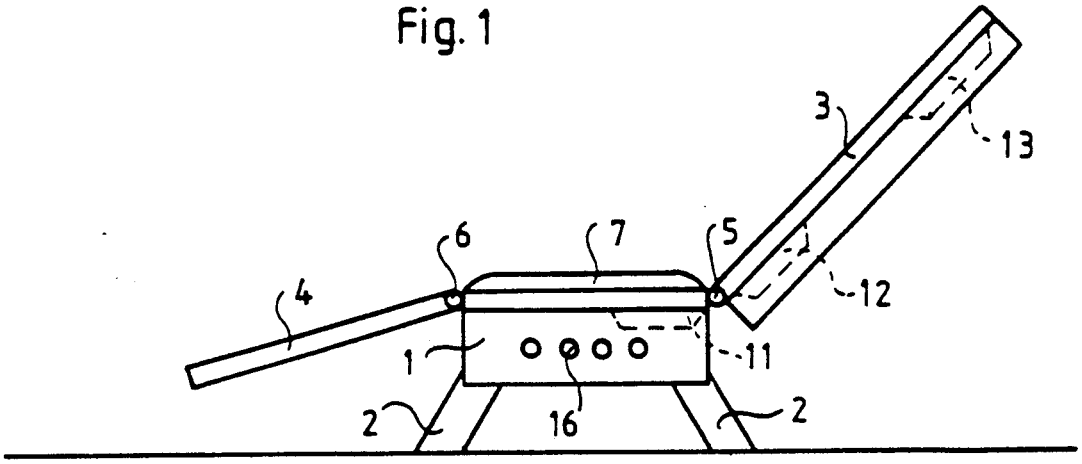
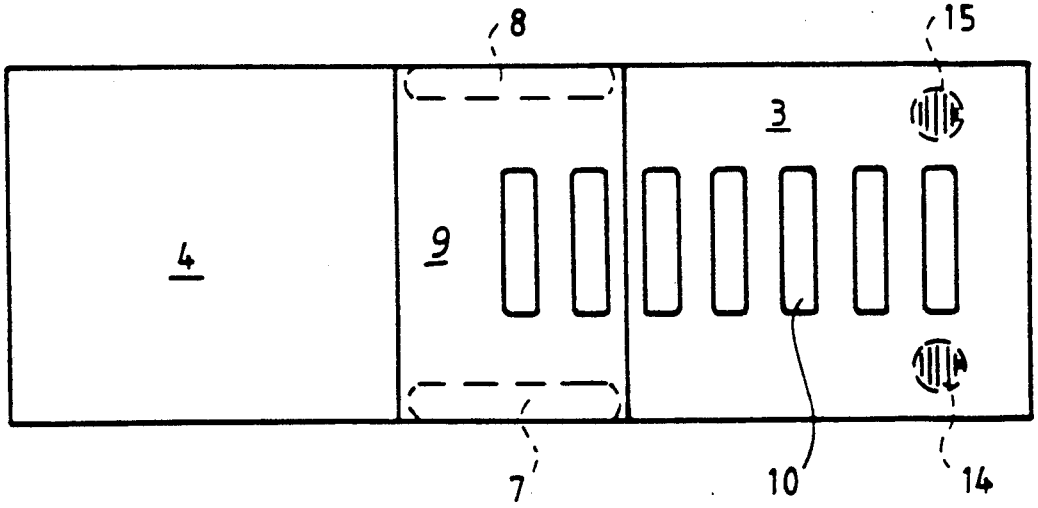
Fig. 2

THERAPEUTIC CHAISE LONGUE

BACKGROUND OF THE INVENTION

The invention relates to a chaise longue for the administration of therapeutic treatment adapted to achieve and facilitate total relaxation of a patient.

Couches or chaise longues for therapeutic treatment which generally consists of three adjustable sections which are pivotally hinged to one another are well known. They have a first section for the support of a patient's back and head, a second section for the support of the thighs and lower back and a third section for the support of the shanks. Pivoting of the three sections relative to one another permits achievement of a relaxing lounge position as well as a comfortable seating position. However a relaxing lounge position will not automatically lead to a patient's full relaxation.

It is therefore the principal object of the present invention to provide the principal object of the utilizes the newest findings in the fields of medicine and psychology concerning relaxation, particularly of total relaxation.

SUMMARY OF THE INVENTION

To facilitate for a patient to achieve a state of total relaxation preferably a three-section chaise longue for the administration of therapeutic treatment of a patient consists of a first support section for the back and the head of the patient, a second support section for the thighs and the lower back of the patient, to one end of which the first section is pivotally mounted, and a third section pivotally mounted to the opposite end of the second section for the support of the patient's shanks wherein the first and second sections have openings formed therein along the centerline of the chaise longue and electroacoustic transducers mounted thereon so as to radiate upwardly through the openings onto the patient with a frequency controlled so as to correspond to the tack frequency of music to which the patient is exposed for musical therapy.

At the end of the 19th century, scientific psychology developed a scientific basis for the effects and healing forces of music. It has been established that music plays a substantial role in changes of pulse frequency, the blood pressure, blood circulation, muscle relaxation, perspiration and oxygen consumption of a person. It was found for example that the exposure to certain types of music avoided or eliminated psychonervous control function disturbances. In connection with functional heart problems, for example, music was used as a sedative, a stimulant or an analgesic. Modern music therapies actually achieve measurable revitalizing states of relaxation and, as a result, positive changes of the parameters mentioned before, that is, improved well feeling and well being of a patient.

All the music therapies are effective to the bodies or rather the minds by way of the hearing organs of a human. However the human mind in many cases acts as a filter and sets up a high threshold which may cause failure of the music therapy. As a matter of fact modern people who, by way of their logic minds, wish to control and direct all their emotions, have generally lost their capability of total relaxation. The results are hypertension, irritability and, of course, physical disturbances.

The present invention utilizes the medical and psychological recognition that, since the first sense given to a human in the human developement is the sense of touch, a human reacts extraordinarily well and reliably to the feel of touch.

It has been tried therefore:

1. To find a deep relaxation-causing music or to compose such music; and

2. To combine such music with the human's sense of touch or feel.

This has been achieved with applicant's chaise longue which not only supplies music suitable for therapy to a person's ears but transmits it in certain soundwave form also directly to the body surface thereby influencing the whole body and providing for a by-pass of the ear and the mind which often is an inhibiting filter. More accurately expressed, the left brain hemisphere responsible for the logic and analytical human thinking process, which does not permit the modern man access to full relaxation, is circumvented. The body reacts to direct stimulation by the music with significant relaxation of muscle tension, with a noticeable change of brain activity with a general and pleasing relaxation and regeneration.

Even though it has been known that therapuetic music can be transmitted to a patient on a direct path without the filter of the mind it is still necessary to find the music most suitable for such therapy. It has been found that music with a 60 cycle rhythm considering rhythm as being formed by a repetitive series of beats per minute has particularly positive results. But this too has been well established knowledge in the field of music therapy. It is new however that in accordance with the present invention the rhythm beginnings of the music are supplied to an amplifier generating signals which are supplied to the electroacoustic transducers associated with the chaise longue at a frequency which is below the audible range. In this manner the body, that is, the body tissue of a person, is subjected to the rhythm frequency while the person does not actually become aware of this and this results in a particularly good body relaxation. It is noteworthy in this connection that brain activity during deep body relaxation is in that frequency range which is not audible for humans as has been determined by measurements. It is also quite interesting to note that the word or takt used in many languages for beat of a rhythm is a derivative of the latin word "tactus" which stands for the sense of touch or feel.

Tests with the chaise longue of the present invention have indicated that three well-definable distinctive areas of the human body are particularly receptive for such acoustic irradiation. These areas are first the head and neck area, second the area of the chest and third the area of the lower body about between the beltline and the thighs. This is why the chaise longue in accordance with the invention is provided with three electroacoustic transducers which are arranged so as to be in these areas. Also in accordance with the invention the chaise longue has openings and the transducers are supported so as to be movable along the chaise longue. This makes it possible to adjust the position of the transducers to bodies of different sizes so as to adjacent the three areas as explained above.

In order to transmit the therapuetic music to a patient also by way of the ears the head part of the chaise longue has wide band speakers mounted to opposite sides thereof, but such speakers may also be disposed at other locations.

The arrangement according to the invention makes it possible for the first time to treat patients with therapuetic music without the inhibiting filtering influence of the ear or rather the controlling mind of a patient.

SHORT DESCRIPTION OF THE DRAWINGS

FIG. 1 is a side view; and

FIG. 2 is a top view of the chaise longue according to the invention.

DESCRIPTION OF THE PREFERRED EMBODIMENT

A housing 1 upholstered on its top side and supported on legs 2 represents the middle portion of the chiase longue. A first support structure 3 for the head and the back of a patient is hinged at 5 to one end of the housing 1 and a third support structure 4 adapted to provide support for the shanks of a patient is hinged to the other end of the housing 1 at 6. The hinges 5 and 6 permit pivotal adjustment of the first and third support structure relative to the center support structure represented by the housing 1. The housing 1 has disposed along the sides thereof upwardly projecting bulges 7, 8 adapted to retain the arms of a patient resting on the chaise longue. The upper (first) support structure 3 and the support surface 9 of the housing 1 have openings 10 formed therethrough along the centerline of the chaise longue below which electroacoustic transducers 11, 12, 13 are supported in such a manner that they are movable along the centerline of the chaise longue. Additional openings 14 and 15 for the wide band speakers are provided at opposite sides of the centerline and at the free end of the support structure 3.

For therapy a patient is placed onto the chaise longue such that his thighs are disposed on the center housing support surface 9 and the back and the head are disposed on the support structure 3. Then the electroacoustic transducers 11, 12 and 13 are adjusted by moving them into appropriate positions below the lower back, the chest and the head for exposure thereof to the sound energy of the transducers. Subsequently the electronic equipment disposed in the housing 1 is operated by adjustment members 16 such that the wide band speakers provide audible music. The rhythm beginnings of the music that is, the first ones of the repetitive beats of a beat pattern forming the rhythm, are supplied to a signal generator which provides a signal to the electroacoustic transducers 11, 12, 13 with a non-audible signal frequency. The length of the signal pulses is adjustable to between 0.1 and 2 seconds. In this manner the patient resting on the chaise longue hears the music from the wide band speakers in the audible range while at the same time a signal emphasizing the rhythm of the music is transmitted to his body tissue in the non-audible range.

The signals for the electroacoustic transducers may also be produced independently by a signal generator which is adjustable as to length and frequency of the signal generated and whose output signals can be synchronized with the rhythm frequency of the music to which the patient is exposed.

What is claimed is:

1. A chaise longue for the administration of therapeutic treatment adapted to facilitate total relaxation of a patient, said chaise longue including a first support section for the support of the back and the head of the patient, a second support section for the support of the lower back and a third support section for the shanks of the patient, said first and second support sections having openings formed therein in spaced relationship along the longitudinal centerline of the chaise longue and electroacoustic transducers mounted below said first and second sections and arranged so as to radiate upwardly through said openings onto a patient resting on said chaise longue, said first section having wide band speakers arranged at opposite sides of said centerline so as to be adjacent the head of a patient resting on said chaise longue for transmitting music to said patient wherein alternating current in the sound frequency range of the music is supplied to the wide-band speakers to be listened to by the patient on the chaise longue and means are provided for sensing the first of the repetitive beats of the beat pattern of the music and a signal generator is provided to supply to said electroacoustic transducers a signal based on the repetitive beat pattern sensed by said sensing means, said signal having an adjustable frequency below the audible range.

2. A chaise longue as defined in claim 1, wherein said first and third sections of said chaise longue are pivotally mounted to opposite ends of said second section.

3. A chaise longue as defined in claim 1, wherein said second section has upwardly projecting bulges disposed along the sides thereof for retaining the arms of a patient resting on said chaise longue.

4. A chaise longue according to claim 1, wherein said music has about 60 beat pattern repetitions per minute.

5. A chaise longue according to claim 1, wherein said music has a certain beat pattern repetition frequency and said signal generator has an adjustable signal time and an adjustable output frequency so that its signals can be synchronized with the beat pattern repetition frequency of said music for supplying these signals to said electroacoustic transducers so as to energize said transducers at the beat pattern repetition rate with said signals of below audible frequency.

6. A chaise longue as defined in claim 1, wherein said acoustic transducers are movable along said longitudinal centerline to permit appropriate position adjustment of said electrouacoutic transducers relative to a particular patient.

* * * * *